United States Patent [19]

Patronis, Jr.

[11] 4,079,199

[45] Mar. 14, 1978

[54] ACOUSTIC FEEDBACK DETECTOR AND AUTOMATIC GAIN CONTROL

[76] Inventor: Eugene T. Patronis, Jr., 1774 Northbridge Rd., Dunwoody, Ga. 30338

[21] Appl. No.: 800,157

[22] Filed: May 25, 1977

[51] Int. Cl.[2] ..... H04R 3/02

[52] U.S. Cl. ..... 179/1 FS

[58] Field of Search ..... 179/1 FS, 1 HF; 325/12

[56] References Cited

U.S. PATENT DOCUMENTS 2,157,177 5/1939 Kellogg ..... 179/1 FS

*Primary Examiner*—George G. Stellar

*Attorney, Agent, or Firm*—Newton, Hopkins & Ormsby

[57] ABSTRACT

A device for detecting the oscillating condition caused by the acoustic coupling between a loud speaker and a microphone at those frequencies which do not satisfy the Nyquist stability criteria, and for thereafter decreasing the system loop gain. The detection circuitry consists of a bank of phase lock loop detectors. Each phase lock loop within the bank covers a limited frequency range such that together the bank covers the entire audio band. Upon detecting an oscillation in the particular phase lock loop frequency passband, that phase lock loop control voltage is automatically internally adjusted to align the phase lock loop frequency with the oscillating frequency. An abnormal phase lock loop control voltage signifies the presence of an unwanted oscillating signal and is detected by circuitry which includes a diode peak detector followed by a pair of voltage comparators. Upon detecting the ringing condition, the loop gain is decreased until the ringing condition ceases. A digital up-down counter is employed to establish the loop gain. The output of this counter is applied to a digital-to-analog converter which in combination with an operational amplifier, a light emitting diode, and a photoresistor form an attenuator circuit which controls the loop gain. Provision is also made for automatically counting down the up-down counter by applying down clocks to this counter at predetermined intervals such that after a certain time period the loop gain is returned to a particular desired setting.

9 Claims, 3 Drawing Figures

ACOUSTIC FEEDBACK DETECTOR AND AUTOMATIC GAIN CONTROL

BACKGROUND OF THE INVENTION

1. Field of the Invention

This invention relates to sound systems, and more particularly to circuits for maintaining the stability of a sound system against ringing sometimes caused by acoustic coupling between the input and the output of the sound system.

2. Description of the Prior Art

Sound systems are often used to provide reinforcement for the speaking voice or musical instruments. In this application, there is always some acoustic coupling between the loud speaker and the microphone so that the entire system forms a closed loop. In order for this loop to be stable, that is, not to go into oscillation, it is necessary that at any frequency for which the overall phase shift is an integral multiple of $2\pi$ radians, the loop gain must be less than one. Any time this stability criterion is violated, the system will begin to oscillate or "ring" at the frequencies for which the loop gain exceeds one. This ringing will persist until something is done to reduce the loop gain below one. The control of this system is accomplished in actual practice by having an operator present. The human hearing mechanism is such that the operator can distinguish the sounds produced by the system in normal operation from sounds characteristic of ringing or oscillation. Whenever the operator detects ringing in the system, he corrects it by reducing the gain in the electronic portion of the system until the ringing ceases. The operator has restored stability by reducing the loop gain below one. The role played by the operator in maintaining system stability against ringing would not be necessary if the system had the ability to detect its own ringing and upon detection of the ringing, to reduce the loop gain of the system until the ringing ceased. Accordingly, there is a need for an electronic device which can assume the operator's function as described above.

SUMMARY OF THE INVENTION

It is therefore one object of the present invention to provide a device for electronically detecting acoustic feedback in a sound system and automatically controlling its gain.

It is another object of the present invention to provide such a device wherein the acoustic feedback is detected by monitoring electrical signals in the sound system which contain the same information as the acoustic signal but in a more convenient form.

It is yet another object of the present invention to provide a method for electronically detecting acoustic feedback in a sound system and automatically controlling its gain.

The objects of the present invention are achieved by a device for detecting and automatically correcting the existence of an oscillating condition caused by acoustic coupling between the input and the output of a sound system such that the system forms a closed loop. The device includes sound distinguishing electronic circuitry for distinguishing between the sounds produced by the system in normal operation and the sounds produced by the system when oscillating so as to detect an oscillating condition; and gain control electronic circuitry responsive to the detecting of an oscillating condition for reducing the loop gain of the sound system from its original value to a value less than one. The sound distinguishing circuitry includes tracking circuitry for tracking the individual frequency components of the sound produced by the system; and detector circuitry operated by the tracking circuitry for indicating the presence of a persistent frequency component, characteristic of oscillation. The gain control electronic circuitry includes a clock for generating a series of clock pulses; a counter; a gate responsive to the detecting of an oscillating condition for gating the clock pulses to the counter to vary its count; and an attenuator responsive to the varying of the count for controlling the loop gain of the sound system.

Another aspect of the present invention involves a method for detecting and automatically correcting the existence of an oscillating condition caused by acoustic coupling between the input and output of a sound system such that this system forms a closed loop. The method includes the steps of tracking the individual frequency components of the sounds produced by the system; indicating the presence of a persistent frequency component characteristic of oscillation; and reducing the loop gain of the sound system from its original value to a value less than one.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

The structure of ordinary speech or music signals is such that there exists little if any correlation between signals examined at time $t_1$ and $t_2$ provided that the time interval $t_2 - t_1$ is greater than the duration of a single syllable in speech or a single note in musical performance. On the other hand, if a system is oscillating, there will be a strong correlation between signals at times $t_1$ and $t_2$ even when the interval $t_2 - t_1$ is large. This correlation exists as a result of the continuous existence of one or more frequency components in the signal. The present invention detects a persistent frequency component.

Figure 1:
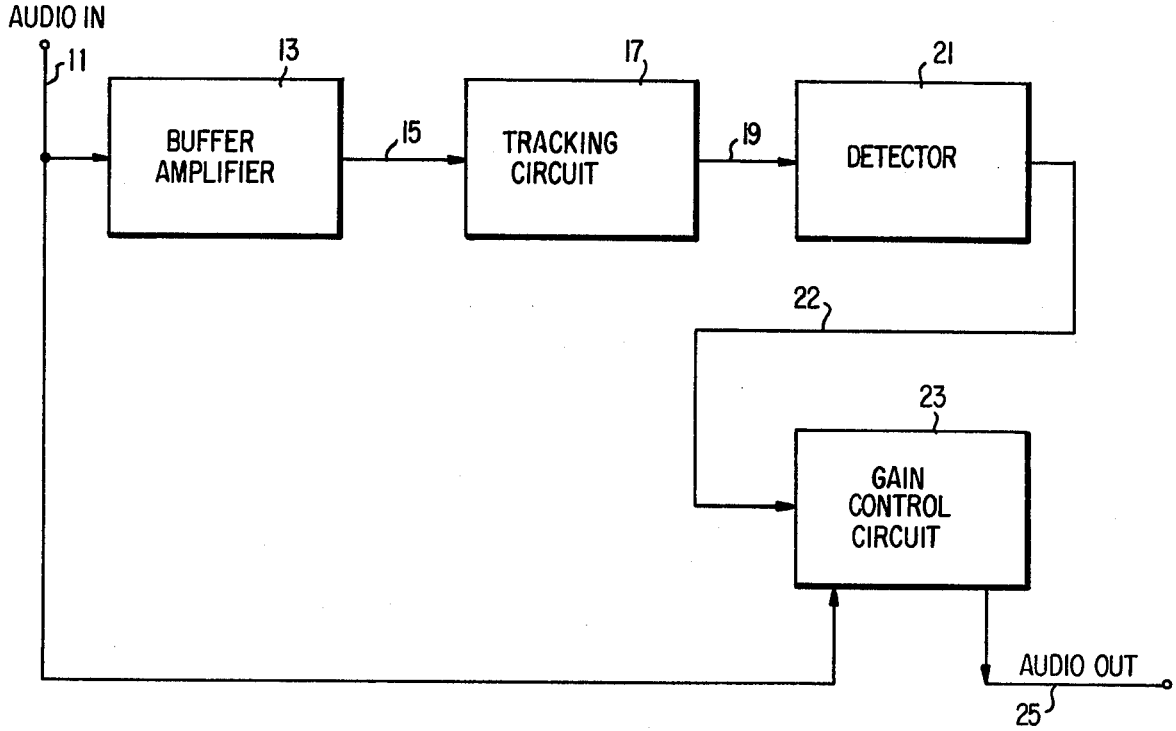
FIG. 1 is a block diagram of the preferred embodiment of the acoustic feedback detector and automatic gain control device of the invention.

Referring now to the drawings, wherein like reference numerals designate identical or corresponding parts, and more particularly to FIG. 1 thereof, there is shown a schematic block diagram of the acoustic feedback detector and automatic gain control device of the present invention. The acoustic signals from a stage of the electronic portion of a sound system are applied on lead 11 as inputs to a buffer amplifier 13 provided for isolation. The output of the buffer amplifier is applied on lead 15 to a tracking circuit 17. The tracking circuit tracks the individual frequency components of the sounds produced by the sound system. When the acoustic signals contain a persistent frequency component as would be the case for the oscillating condition in the sound system, the output from the tracking circuit 17 is a large positive voltage excursion. This voltage excursion continues to exist as long as the responsible frequency component remains in the input signal. The output of the tracking circuit 17 is applied over connections represented by lead 19 to detector 21. The presence of a positive output from the detector 21 indicates the fact that the original exciting signal contains a persistent frequency component. A gain control circuit 23 is connected by leads 11 and 25 between stages of the electronic portion of the sound system, as for example, between a preamplifier or mixer and a power amplifier. The output of the detector 21 is also provided over lead 22 to the gain control circuit 23. The gain control circuit responds to the detection of a persistent frequency component by increasingly introducing attenuation into the acoustic signals. When the attenuation becomes sufficiently large to reduce the sound system loop gain below one, the sound system ceases to ring. The gain control circuit 23 gradually restores the system gain to its original value after an interval chosen to insure that the sound system does not revert to the ringing condition.

Figure 2:
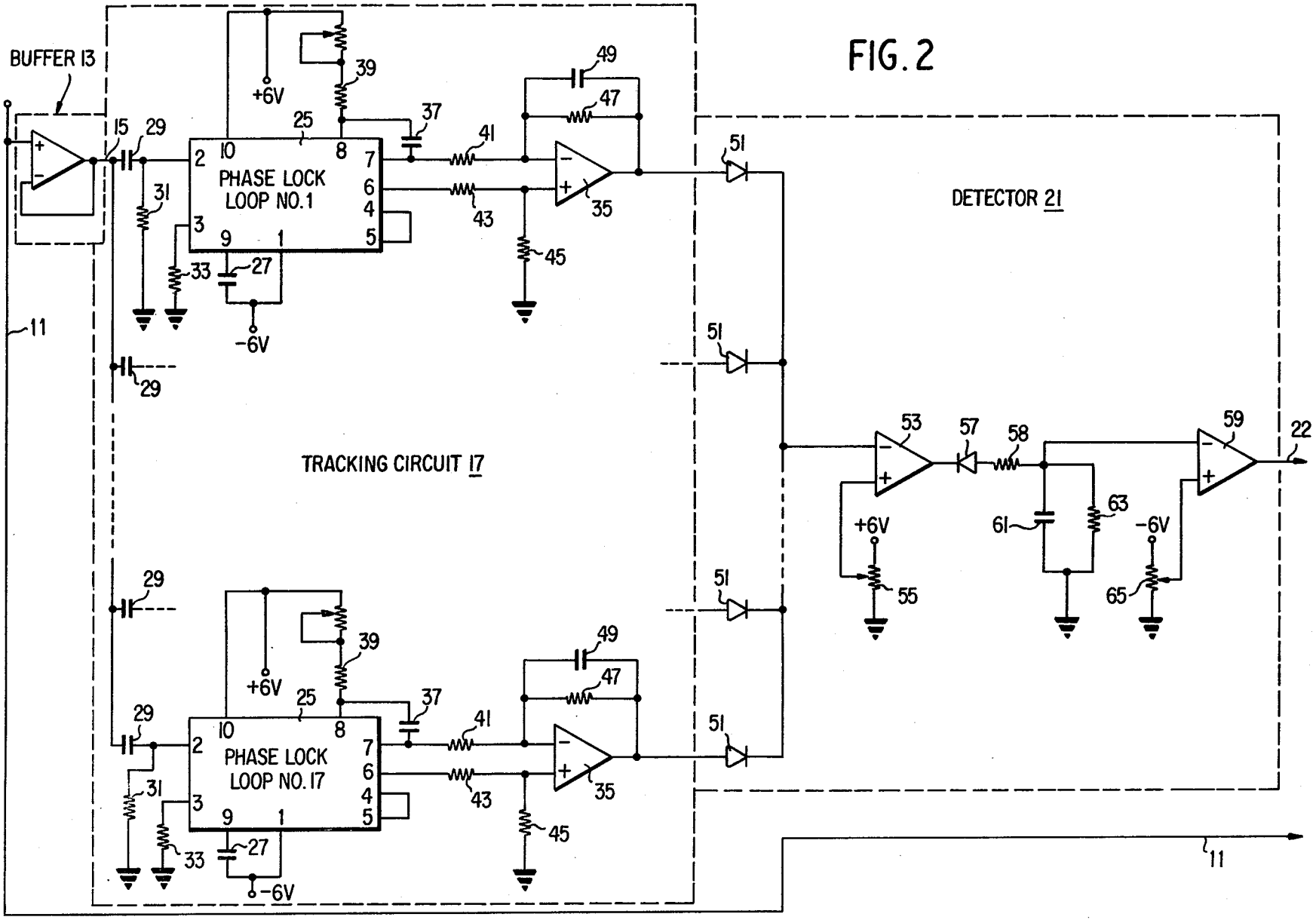
FIGS. 2 and 3 collectively show a schematic circuit diagram of the preferred embodiment of the acoustic feedback detector and automatic gain control device of the invention.
Figure 3:
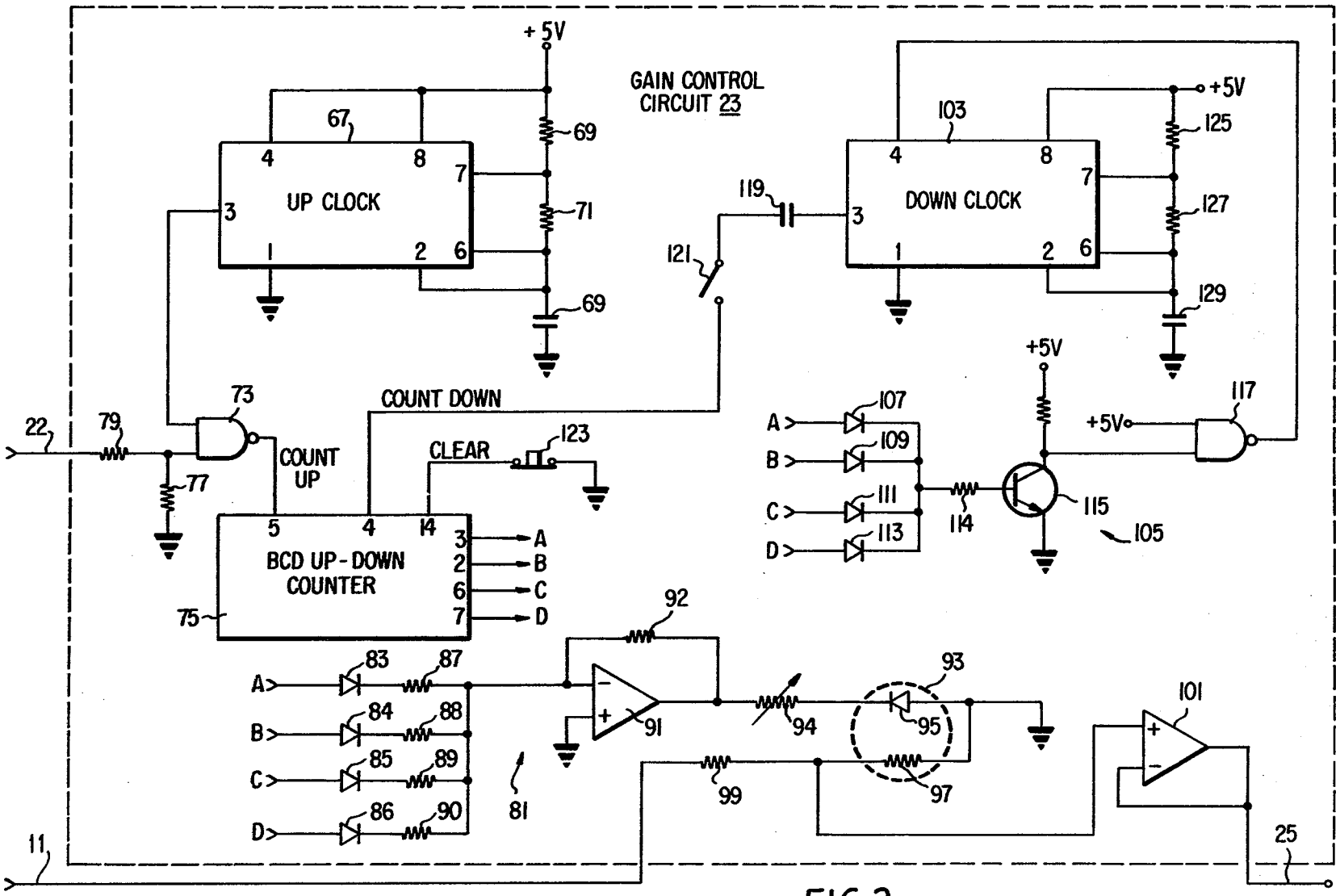

The prime embodiment of this invention is more particularly described with reference to FIGS. 2 and 3 which collectively show a schematic circuit diagram of the acoustic feedback detector and automatic gain control device of the present invention. The circuits outlined in FIGS. 2 and 3 by broken lines carry the same reference numbers as the blocks in FIG. 1.

Enclosed by a broken line 13 is the buffer amplifier. The buffer amplifier 13 is a non-inverting unity gain amplifier. The output of the buffer amplifier 13 is connected by lead 15 to tracking circuit 17. Tracking circuit 17 is seen to include 17 phase lock loop-amplifier combinations. Each phase lock loop 25 is preferably a conventional integrated circuit commercially available as a Model 565 phase lock loop from Signetics, Inc. The terminals of the integrated circuit are connected as follows: terminal 1 to a source of −6 volts and one end of a tuning capacitor 27, terminal 2 to the audio input on lead 15 via a capacitor 29 and a resistor 31 forming a high-pass filter, terminal 3 to an input bias resistor 33, terminal 4 to terminal 5, terminals 6 and 7 to an inverting differential amplifier (described subsequently), terminal 8 to the inverting differential amplifier 35 by a capacitor 37 and to a tuning resistor 39 which is coupled to a source of +6 volts, terminal 9 to the other end of the tuning capacitor 27, and terminal 10 to the source of +6 volts. The inverting differential amplifier 35 includes coupling resistors 41 and 43 connected to the inverting and non-inverting inputs respectively, a bias current offset resistor 45 between the non-inverting input and ground, and a feedback loop including a resistor 47 and a capacitor 49 around the operational amplifier designed to give it a low pass filter characteristic.

The free-running frequency, $f_0$, of the voltage controlled oscillator of each phase lock loop 25 is determined by the magnitude $R_T$ of the tuning resistor 39 and $C_T$ of the tuning capacitor 27 and is given by:

$$f_o = 1.2/4R_TC_T$$

The lock range of this loop extends from:

$$0.4f_o \text{ to } 1.6f_o$$

The output of each phase lock loop and amplifier combination when excited by a signal in this frequency range is:

$$E_o = k(f_s - f_o)$$

where $f_s$ is the frequency of the signal and $k$ is a constant. Note that $$0.4f_o \leqq f_s \leqq 1.6f_o.$$

If $f_s$ is outside of the lock range, $E_o$ is 0. In order to be responsive to audio signals in the frequency range of 50Hz. to 15,000 Hz., 17 of these phase lock loop-amplifier combinations are employed with each phase lock loop having a different free-running frequency $f_o$ as set forth by the following equation:

$$f_o = (\sqrt{2})^{n-1}\,50\text{Hz}$$

$n = 1, 2, 3, 4 \ldots 17$

This assignment assures that for any signal having a frequency component $f_s$ in the interval $$50\text{Hz.} < f_s < 15{,}000\text{Hz.}$$

There will be at least one phase lock loop-amplifier combination for which $$E_o > 0.$$

When this array is fed by a signal source which furnishes an electrical signal analogous to ordinary speech and music signals, the output voltages of the individual loops will be found to be sometimes positive, sometimes zero, and sometimes negative as the loops attempt to track the individual frequency components in their respective lock ranges. These individual excursions away from zero are usually though not always small, and are always of short durations. When the array is fed an electrical signal which contains a persistent frequency component as would be the case for the ring condition in a sound system, the output of at least one phase lock loop-amplifier combination will be a large positive voltage excursion which will continue to exist as long as the resposible frequency component remains in the input signal.

This behavior is detected by the detector 19. In the detector, the positive output from any of the 17 phase lock loop-amplifier combinations is coupled through respective diodes 51 to the inverting input of a comparator 53. A variable reference voltage is provided at the non-inverting input of the comparator 53 by the sliding arm of a potentiometer 55 coupled to a source of +6 volts. The output of the comparator 53 is coupled via a diode 57 and a resistor 58 of magnitude R2 to the inverting input of a comparator 59 and to ground through a capacitor 61 of magnitude C1 and a resistor 63 of magnitude R3. The non-inverting input of the comparator 59 receives a variable reference voltage from a potentiometer 65 coupled to a source of −6 volts, and its output is connected by lead 22 to the gain control circuit 21. The first comparator 53 responds only to positive signals which exceed its threshold as determined by the setting of the potentiometer 55. In the absence of any input signal, the output of the first comparator 53 is in its positive state and the diode 57 is reverse biased. Upon the application of a sufficiently large positive voltage to the input of the comparator 53, the comparator output switches to its negative state allowing the capacitor 61 to charge through the resistor 58 and the diode 57. If the input to the first comparator 53 falls below threshold after a short time, its output will revert to its positive state, diode 57 will again be reverse biased, and capacitor 61 will discharge through resistor 63 without ever having acquired a large negative voltage. On the other hand, if the input to the first comparator 53 remains above the threshold for an appreciable length of time, the voltage on capacitor 61 will grow to a large negative value. The voltage across capacitor 61 is applied to the input of the second comparator 59. The second comparator has a negative threshold voltage as determined by the setting of the potentiometer 65. As long as the negative voltage on capacitor 61 is small, the output of the second comparator 59 is in its negative state. If the voltage on capacitor 61 becomes sufficiently negative to exceed the second comparator's threshold, the second comparator 59 will switch to its positive state. In order then for the second comparator to switch from its negative to its positive state, at least one phase lock loop-amplifier combination must have a large positive output for an appreciable period of time. The time interval demanded is determined by the time constant $$R2\ R3\ C1/(R2 + R3)$$

and the threshold setting of the second comparator. Once the second comparator 59 has switched to its positive state, it will remain there until the capacitor 61 is allowed to discharge. This will not occur, however, until after the input to the first comparator 53 falls below threshold, i.e., not until the persistent frequency component signal is removed from the input of the phase lock loop circuitry. The presence then of a positive output from the second comparator 59 denotes the fact that the original exciting signal contains a persistent frequency component.

The output of the detector 21 is fed over lead 22 to the gain control circuit 23. The gain control circuit 23 includes an UP clock 67 illustrated at the left upper portion of FIG. 3. The UP clock is preferably a conventional integrated circuit commercially available as a model 555 timer from Signetics, Inc. The UP clock 67 includes the necessary biasing and trimming circuitry as indicated at 69 and further includes a resistor 71 for adjusting the output frequency. The output terminal 3 of the UP clock 67 is coupled to one input of a two-input NAND gate 73 which is connected to the count up control terminal 5 of a binary-coded-decimal (BCD) up-down counter 75. The other input of the NAND gate 73 is connected to ground by means of a resistor 77 and to the output lead 22 from the detector 21 by a resistor 79. The BCD counter 75 is preferably implemented with a Signetics model 74192, a commercially available device. A digital-to-analog converter 81 consists of a binary weighted network of diodes 83–86 and resistors 87–90 coupled to the inverting input of an operational amplifier 91 having a gain control resistor 92 connected between the output terminal and the inverting input terminal. The output terminals 3, 2, 6 and 7 of the BCD counter 75 are coupled to the inputs of the binary weighted network of the digital-to-analog converter 81. The output of the digital-to-analog converter 81 is connected to an optical coupler 93 through a variable resistor 94. The optical coupler 93 includes a light emitting diode 95 connected with a photoresistor 97. Photoresistor 97 is coupled via a resistor 99 to lead 11 for receiving the audio signal from the sound system and to the output lead 25 of the gain control circuit via a buffer amplifier 101. The buffer amplifier is a noninverting unity gain amplifier. A DOWN clock 103 illustrated at the right upper portion of FIG. 3 is also provided. The DOWN clock 103 is preferably the same model as the UP clock 67 discussed previously. The output terminals 3, 2, 6 and 7 of the BCD counter 75 are coupled through a gating circuit 105 comprising diodes 107, 109, 111 and 113, transistor 115 and a NAND gate 117 to the input terminal 4 of the DOWN clock 103. The output terminal 3 of the DOWN clock 103 is coupled through a coupling capacitor 119 and a switch 121 to the count down control terminal 4 of the BCD counter 75. A push-button switch 123 couples the clear terminal 14 of the BCD counter 75 to ground.

In operation, the UP clock 67 free runs to produce approximately one positive going pulse per second. The BCD counter 75 is in the zero state as long as the sound system operation is normal. The output of the two input NAND gate 73 remains in the high state in the absence of a positive signal from the detector 21. The binary coded decimal count contained in the counter 75 is converted into a proportional analog signal by the digital to analog converter 81. The digital-to-analog converter 81 drives the light emitting diode 95 through the resistor 94. The light emitting diode 95 illuminates the resistor 97 which in conjunction with the resistor 99 forms an attenuator. In the absence of light from the light emitting diode 95, resistor 97 adds a value which is large compared to resistor 99 and there is no attenuation of the audio signal. The operational amplifier 101 following the attenuator is connected as the unity gain buffer to make the action of the attenuator independent of load.

The gain control circuit 23 has two modes of operation. In the first mode, the switch 121 is open and the DOWN clock 103 and its associated circuitry can be ignored. Following the detection of a ringing condition in the sound system, a positive voltage level is supplied to the NAND gate 73 by the detector 21. Negative going pulses from the UP clock 67 are thus gated into the counter 75 at the rate of one per second. Each successive pulse advances the decimal state of the counter 75. The digital-to-analog converter 81 produces a voltage which at any instant is proportional to the decimal state of the counter 75 and drives the light emitting diode 95 through resistor 94. The parameters can be chosen so that each decimal step of the counter will cause the attenuator to introduce an attenuation between 1 and 3 dB depending on the setting of resistor 94. For example, suppose resistor 94 is adjusted for two dB per step and the decimal state of the counter 75 is 3. Then the audio signal would be attenuated by 6 dB. The state of the counter 75 and the attendant attenuation will continue to increase in steps until the attenuation becomes sufficiently large to reduce the sound system loop gain below 1, when the sound system ceases to ring and the voltage level from the detector 19 becomes negative. UP clock 67 pulses will no longer be gated into the counter 75 and the counter will remain in its previous decimal state. The attenuation remains at the value corresponding to the final state of the counter. The counter 75 can accept nine steps without overflow. This is more than sufficient for ordinary applications since nine steps yields an attenuation of 18 dB. More steps could of course be provided if they were found necessary or the amount of attenuation per step could be increased. The sound system will now continue to operate but at a reduced gain. This gain reduction will remain in force until the counter 75 is manually cleared by depressing the clear switch 123.

This mode of operation described above suffers in that the gain is never restored to the original value without the presence of an operator. When sound systems are originally set up, the microphone is positioned and the gain is manually adjusted so that the system is stable against ringing. The ringing condition is later brought about as a result of a performer cupping his hand around the microphone or as a result of a performer carrying the microphone to a position which tends to increase the loop gain. In either case it is usually an event of short duration which precipitates the feedback condition. The system gain needs to be reduced for the duration of the event but can be restored afterwards. The gain control circuit 21 offers a second mode of operation to handle this situation. In this mode, the switch 121 is closed. Diodes 107–113, transistor 115, and the NAND gate 117 taken together form a gating circuit which allows the DOWN clock 103 to run whenever the counter 75 is in a decimal state other than zero. Whenever a ringing condition has forced the counter 75 out of its decimal zero state, the DOWN clock 103 will begin to run. Whereas the UP clock 67 produces pulses of one per second, resistors 125, 127 and capacitor 129 are chosen so that the DOWN clock 103 produces pulses at a rate of say 1 per minute, or 1 per 10 minutes, or 1 per any time interval which is considerably longer than that of the UP clock 67. Suppose that as a result of a ringing condition, the counter 75 has advanced to the decimal state three thus introducing 6 dB. of attenuation. The DOWN clock 103 has been gated on and is running at the rate of one pulse per ten minutes. After an interval of ten minutes, a negative going pulse of short duration will be coupled through the capacitor 119 to the DOWN count terminal of the UP and DOWN counter 75. The decimal state of the counter 75 will now become two and the attenuation will become 4 dB. This process will repeat itself two more times until the counter returns to zero at which time the DOWN clock 103 will be gated off. This assumes of course that the ringing has not reoccurred during the down count interval. If ringing had reoccurred, the decimal state of the counter 75 would have been advanced by the UP clock 67 to restore sound system stability and the DOWN clock 103 would have continued to run. In any event, the DOWN clock period can be selected so that the system will eventually restore the gain to the original value but will not be reverting to the ringing addition on a short term basis.

There are many other modes of operation which may be implemented by additional control circuitry of greater sophistication. However, the two principal features discussed above, i.e., prompt introduction of attenuation upon the detection of ringing followed by gradual restoration of system gain must be possessed by any system designed to replace an operator since these are the steps taken by an operator himself.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for detecting and automatically correcting the existence of an oscillating condition caused by acoustic coupling between the input and the output of a sound system such that the sound system forms a closed loop comprising:

sound distinguishing electronic tracking means for distinguishing between the sounds produced by the sound system in normal operation and the sounds produced by the sound system when oscillating so as to detect an oscillating condition; and gain control electronic means responsive to the detecting of an oscillating condition for reducing the loop gain of the sound system from its original value to a value less than one.

2. The device recited in claim 1 wherein the sound distinguishing means includes:

tracking means for tracking the individual frequency components of the sounds produced by the sound system; and detector means operated by the tracking means for indicating the presence of a persistent frequency component characteristic of oscillation.

3. The device recited in claim 2 wherein the tracking means includes:

a phase lock loop; and an inverting differential operational amplifier connected to the phase lock loop.

4. The device recited in claim 2 wherein the tracking means includes:

a plurality of frequency contiguous phase lock loops; and a plurality of inverting differential operational amplifiers, each of the plurality of amplifiers being connected to a respective one of the plurality of phase lock loops.

5. The device recited in claim 2 wherein the detector means includes:

a first comparator for comparing the output of the tracking means to a first reference voltage;

means responsive to the output of the first comparator for acquiring a voltage; and a second comparator for comparing the voltage of the acquiring means to a second reference voltage;

6. The device recited in claim 1 wherein the gain control means includes;

a first clock for generating a first series of clock pulses;

a counter;

means responsive to the detecting of an oscillating condition for gating the first series of clock pulses to the counter to vary the count of the counter; and an attenuator adapted to be coupled into the sound system and responsive to the varying of the count for controlling the loop gain of the sound system.

7. The device recited in claim 6 wherein the gain control means includes;

a second clock for generating a second series of clock pulses; and means responsive to the varying of the count of the counter for gating the second series of clock pulses to the counter to vary the count of the counter in the reverse direction.

8. A method for detecting and automatically correcting the existence of an oscillating condition caused by acoustic coupling between the input and the output of a sound system such that the sound system forms a closed loop comprising the steps of:

tracking the individual frequency components of the sounds produced by the sound system;

indicating the presence of a persistent frequency component characteristic of oscillation; and reducing the loop gain of the sound system from its original value to a value less than one.

9. The method recited in claim 8 wherein the reducing step includes the steps of:

generating clock pulses;

gating the clock pulses to a counter; and attenuating the sound of the sound system in proportion to the count of the counter.

* * * * *